United States Patent [19]

Malcolm

[11] 4,290,091

[45] * Sep. 15, 1981

[54] SPRAY GUN HAVING SELF-CONTAINED LOW VOLTAGE AND HIGH VOLTAGE POWER SUPPLIES

[75] Inventor: David H. Malcolm, Randolph, N.J.

[73] Assignee: Speeflo Manufacturing Corporation, Houston, Tex.

[ * ] Notice: The portion of the term of this patent subsequent to Aug. 26, 1997, has been disclaimed.

[21] Appl. No.: 47,372

[22] Filed: Jun. 11, 1979

Related U.S. Application Data

[63] Continuation of Ser. No. 754,161, Dec. 27, 1976, abandoned.

[51] Int. Cl.[3] ..... B05B 5/02

[52] U.S. Cl. ..... 361/228; 361/226; 239/690

[58] Field of Search ..... 361/227, 228, 229, 235; 310/156; 415/119; 239/692, 690, 3

[56] References Cited

U.S. PATENT DOCUMENTS

| | | | |
|---|---|---|---|
| 1,360,654 | 11/1920 | Littlefield | 361/228 |
| 2,897,596 | 8/1959 | Maurer | 415/119 |
| 3,610,528 | 10/1971 | Felici | 239/692 |
| 3,653,592 | 4/1972 | Cowan | 361/227 |
| 3,731,145 | 5/1973 | Senay | 361/235 X |
| 3,745,413 | 7/1973 | Whitmore | 361/229 |
| 4,095,130 | 6/1978 | Oshima et al. | 310/156 |

*Primary Examiner*—J. D. Miller
*Assistant Examiner*—L. C. Schroeder
*Attorney, Agent, or Firm*—Pearne, Gordon, Sessions, McCoy & Granger

[57] ABSTRACT

An electrostatic spray gun apparatus for coating systems having an entirely self-contained light weight electrical power supply adapted to convert the kinetic energy available in a moving air stream into the required high d.c. potential and which dispenses with external electrical supply connections thereto.

30 Claims, 8 Drawing Figures

SPRAY GUN HAVING SELF-CONTAINED LOW VOLTAGE AND HIGH VOLTAGE POWER SUPPLIES

This application is a continuation of application Ser. No. 754,161, filed Dec. 27, 1976, now abandoned.

This invention relates to electrostatic spray coating systems wherein the deposition of coating materials upon a workpiece is enhanced through the application of electrostatic forces and particularly to an improved spray gun apparatus incorporating an entirely self-contained electrical power supply.

Electrostatic spray coating systems of both the air atomized and airless types are widely utilized in paint spraying and for deposition of other coating materials. Spray gun apparatus conventionally employed therein is generally constituted by an insulating barrel member having a grounded handle or mount disposed at one end thereof and a selectively sized and shaped high voltage electrode extending from the other end thereof disposed adjacent to the locus of atomization. Such electrode is usually charged to a potential in the neighborhood of from 30 to 85 kilovolts, and in certain installations as high as 150 kilovolts, to create a corona discharge condition and a concomitant electric field of appreciable magnitude. Under such conditions, the corona discharge current flowing from the high voltage electrode creates a region adjacent to the locus of atomization rich in unipolar ions that attach themselves to and charge the paint or other coating material spray droplets. Alternatively, for conductive coating materials contact charging of the spray droplets will occur in the high field strength region around the fluid orifice. The charged droplets are then displaced, under the conjoint influence of their own inertial forces and the electrostatic field extant in the spray region, toward a grounded workpiece. In accord with conventional practice, maximum paint savings are generally effected by maintaining the charging voltage as high as possible and of such magnitude as to produce an average depositing field strength of at least 5,000 volts/inch, and preferably as high as 10,000 volts/inch, between the spray gun and the workpiece. As a concomitant thereto, the spray velocity in the vicinity of the workpiece should be of minimal magnitude consistent with the demands of adequate atomization and paint flow.

The requisite charging voltages are conventionally obtained either through the utilization of externally located standard electronic high voltage power supplies or by the incorporation of an electrogasdynamic high voltage generator within the spray gun body. The standard electronic high voltage power supplies are relatively large, heavy and expensive and are so constituted as to inherently function with essentially "constant voltage" type characteristics. In addition thereto and because of the magnitude of the potentials involved, the high voltage cable interconnecting such power supply with the spray gun is heavy, bulky and relatively inflexible, adding undesired weight to the gun assembly which, because of the concomitant high voltage insulation requirements is rendered unduly large, complex and in most instances not field serviceable.

While the electrogasdynamic powered spray coating apparatus is possessed of several advantageous features as compared to the standard high voltage power supplies, such conventionally require external generation of the relatively low, but still multi-kilovolt, excitation potentials for the spray apparatus contained electrogasdynamic generator and as such, require utilization of an external power supply connected to the spray head as well as requiring the use of pre-conditioned or "seeded" air for reliable operation thereof.

The avoidance of dependence upon a "seeded" air supply and the minimization, if not elimination, of all external power supplies and associated electrical connections to the electrostatic spray apparatus has been a long-sought objective in this field. However, the antithetical requirements of required high operating potentials with attendant current limiting or constant current characteristics, the required utilization of conventionally available compressed air supplies and the avoidance of deleterious discharge potentials, all within the framework of light weight, small size and extended trouble-free operation over long periods of time have effectively precluded, despite various suggested solutions, practical realization of this objective.

This invention may be briefly described as an improved construction for a light weight electrostatic spray coating apparatus incorporating an entirely self-contained electrical power supply and which includes, in its broadest aspects, means for converting the kinetic energy of a moving air stream into kinetic energy of a rotating solid and means for converting the latter into electrical energy appropriate for application to the spray apparatus charging electrode. Pursuant thereto, the invention broadly includes an air driven low voltage alternator, a rectifier and voltage regulator for converting the alternator output into a substantially constant d.c. voltage input for a high frequency oscillator and a multi-stage voltage multiplier for further increasing the magnitude of the transformed output voltage of the high frequency oscillator and converting the same to the 30-100 kilovolt potential level conventionally required to effect the electrostatically enhanced deposition of coating materials. In its narrower aspects, the subject invention includes the provision of a spray head incorporating a light weight, self-contained power supply made up of a high speed, impulse-type, low-inertia air motor directly driving a magnetic armature low voltage alternator, a solid state rectifier and voltage regulator for converting the alternator output into a substantially constant d.c. voltage input for a high frequency oscillator adapted to provide a stepped up or transformed essentially square or sine wave output of about 2.5 kilovolts peak and a solid state multi-stage voltage multiplier employing standard 5 kilovolt components for increasing the magnitude of the transformed output voltage of the high frequency oscillator to the 30 to 100 kilovolt level required to effect the electrostatically enhanced deposition of coating materials.

In a still narrower aspect, the subject invention includes the selective combination of diminutive and light weight components operative within a framework of mechanical and electrical operating parameters that provide an operative light weight electrostatic spray gun unit adapted to utilize conventional plant compressed air supply as the prime movant and to deliver conventionally required output voltages for paint spraying and the like at acceptably low current levels.

Among the advantages of the subject invention is the provision of a light weight diminutively sized and readily manipulable electrostatic spray gun that dispenses with all external electrical connections thereto and the provision of a self-contained electrical power generating system for electrostatic spray coating apparatus that derives its electric power solely through direct conversion of the kinetic energy of a moving air stream. Other advantages of the subject invention include the provision of a self-contained high voltage power supply for electrostatic paint spray guns that is drivable from conventionally available compressed air sources and employs readily available electrical components; the provision of a diminutive high voltage power supply of enduring and reliable character adapted to produce output voltages of 30–100 kilovolts at a current level in the order of 50 microamperes; and the provision of a reliable high voltage power supply adapted to be contained within a hand-holdable spray coating apparatus without materially increasing the weight thereof. Still further advantages of the subject invention include the provision of electrostatic spray coating apparatus that is completely free of any external electrical power connections and requires only an available, conventional source of compressed air for operability. Yet another advantage of the subject invention is the provision of a cartridge type multielement power supply made up of essentially monolithic subassemblies that are assemblable and are individually replaceable for easy field servicing thereof.

In more particularity, the practice of the herein disclosed invention provides an electrostatic spray gun assembly having an entirely self-contained electrical power supply that is devoid of external electrical connection thereto and which is characterized by conventional operational parameters of a required 30–100 kilovolt output at approximately 50 microamps; a power level of approximately 3 watts; a total weight of between about 1½ to 3 pounds and the utilization of conventionally available compressed air supply of between about 20 to 80 psig at flow rates of no greater than 5 scfm.

The primary objective of this invention is the provision of improved electrostatic spray coating apparatus incorporating an entirely self-contained electrical power supply.

Among the further objects of the invention is the provision of an improved power supply construction for electrostatic spray coating operations of such diminutive size as to be disposed within the spray head apparatus and drivable by compressed air.

Still another object of this invention is the provision of a self-contained and improved cartridge type power supply for electrostatic spray coating devices that is readily field replaceable.

Other objects and advantages of the subject invention will be apparent from the following portions of this specification and claims and from the appended drawings which illustrate, in accord with the mandate of the patent statutes, a presently preferred construction incorporating the principles of this invention.

Referring to the drawings.

Figure 1:
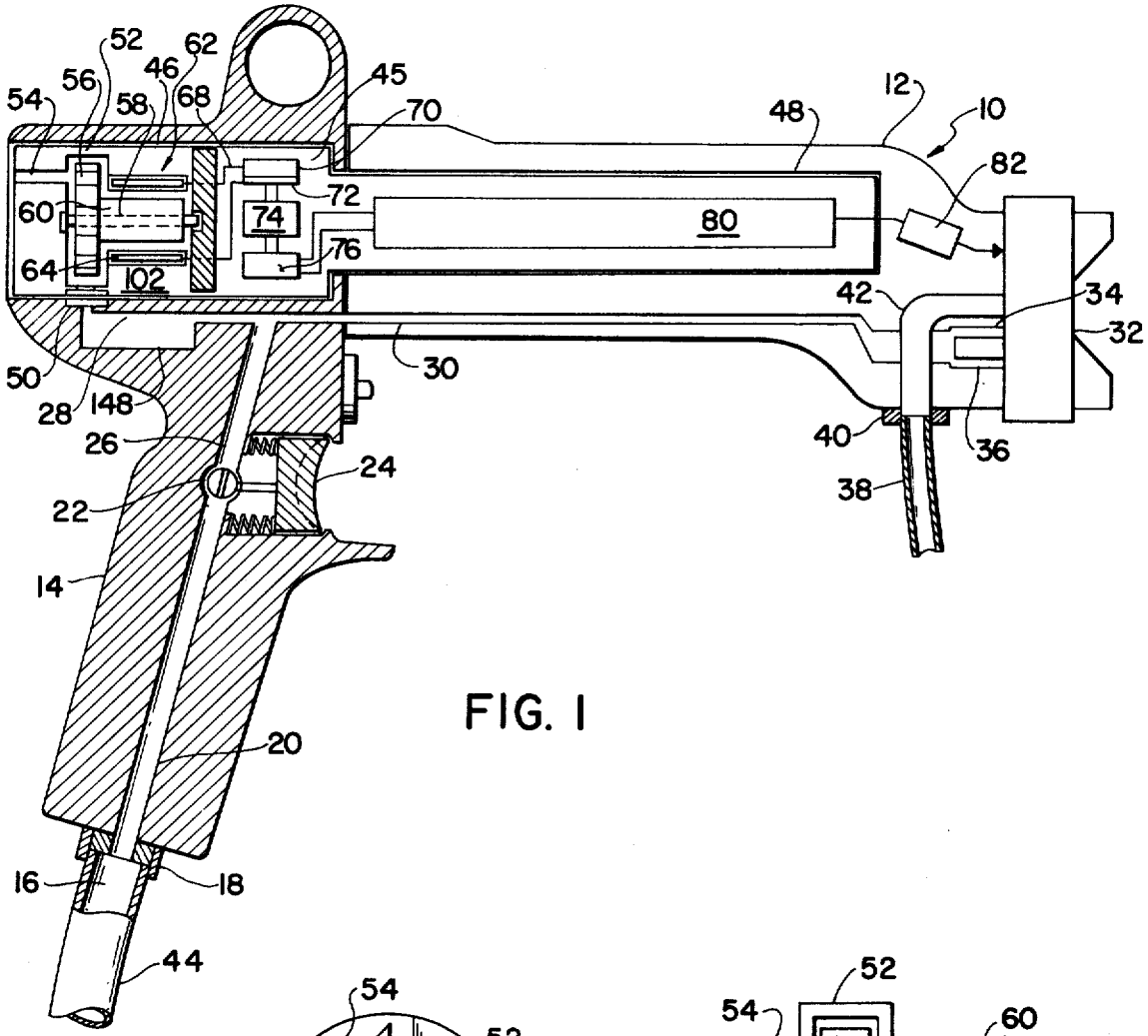
FIG. 1 is a schematic side elevational view, partly in section, showing the disposition of the elements of the power supply disposed within a hand manipulable spray gun of the air atomizing type.

Referring to the drawings and initially to FIG. 1, there is generally and schematically illustrated the components of a hand manipulable type of electrostatic spray gun 10 for paint spraying and the like embodying the principles of this invention. As there shown, such spray gun 10 includes a generally cylindrical and elongate barrel portion 12 formed of insulating material and a pistol grip type handle 14 formed of conducting material and whose upper portion encircles the rear end of the barrel portion 12. An air hose 16 connectable to a remote source of compressed air (not shown), suitably a conventional compressed plant air supply capable of supplying air at a pressure range of from 20 to 80 or more psig and at a flow rate of at least about 3 scfm, is connected to the base of the handle 14 through a suitable fitting 18.

As clearly shown in FIG. 1, a spray gun 10 constructed in accordance with the principles of this invention differs from those conventionally employed in both air atomized and airless electrostatic spray coating systems in that it has connected thereto only a paint supply line or hose 38, an air supply line 16 and a ground connection and is totally devoid of external electrical power supply connections thereto. The subject construction thus completely dispenses with the heretofore required large and heavy floor supported electronic power supply units and the associated heavy and relatively inflexible insulated cables required to transmit the externally generated charging potentials to the gun, as well as also dispensing with the seeded air supply and the insulated electrical cable conventionally required to transmit the excitation potentials to electrogasdynamically powered spray gun assemblies.

Disposed within the handle 14 is an air flow conduit 20 connected to a flow control valve 22 operable through displacement of a trigger 24 by the user of the gun. The output side of the flow control valve 22 is connected to a conduit 26 which fluidly connects with a primary air flow conduit 30 and an auxiliary air flow conduit 28 within the gun barrel 12. The primary air flow conduit 30 serves (in an air atomized gun of the type described) to convey a flow of compressed air to an air cap assembly 32 wherein, as indicated by the further subdivided air flow conduits 34 and 36, such air may be used for conventional air induced atomization of the coating material introduced from a remote supply through the hose 38 and fitting 40 and conveyed to the air cap assembly 32 via conduit 42 and/or may be employed as "fan" air for shaping the emitted spray of the atomized coating material.

The structure and configuration of the air cap assembly 32 and the internal design of the air and coating material conduits therewithin may be essentially conventional in nature and U.S. Pat. Nos. 3,645,447, 3,693,877, 3,843,052 are exemplary of suitable constructions therefor. The electrode system incorporated in the air cap 32 may also be conventional, as is the grounding of the conductive handle portion 14 by means of a conductive sheath 44 disposed around the air hose 16 or by means of a suitable ground lead associated therewith.

Disposed within the barrel portion 12 and the upper section of the handle portion 14 of the gun 10 is an elongate removable power supply cartridge member 45. The cartridge member 45 contains the hereinafter described operative components of the power supply and is of generally cylindrical configuration having a rear section 46 of appreciably greater diameter than its forward section 48.

When the cartridge 45 is properly seated within its complementally contoured receiving bore within the gun barrel 12, the auxiliary air flow conduit 28 is directly connected to an input nozzle 50 of a diminutive air motor assembly 52 to rotatably drive the rotor 56 thereof at high speed. The air flow through the air motor 52 may suitably be vented to the atmosphere through an exhaust channel 54 at the rear of the gun barrel 12. The rotor 56 of the air motor 52 is mounted on a common shaft 58 with the armature 60 of an adjacent alternator 62 to form an effectively integral low inertia assembly capable of rapid acceleration to high speeds with a concomitant long life. The armature 60 is disposed within a cylindrical epoxy coated sleeve type stator 64 of high permeability steel having preferably at least a pair of coils disposed thereabout. Desirably, the air motor 52 and the alternator 62 comprise an essentially integral subassembly that is both of small size and light weight. The described direct coupling of the air motor 52 with the alternator 62 operates to effect a direct conversion of kinetic energy available in the moving air stream in conduit 28 into electrical energy in the nature of an alternating voltage suitably of about 8–16 volts r.m.s. at a frequency of about 250 cycles/sec.

The alternating voltage output of the alternator 62 is introduced, through leads 68, into a rectifier 70 and voltage regulator 72 wherein it is converted into a substantially constant DC voltage, suitably of about 8 to 12 volts in magnitude. The regulated output voltage of rectifier 72 drives a high frequency oscillator 74 to produce a low voltage sine or square wave output suitably at a frequency in the range of from 10 to 50 kilohertz. The high frequency but low voltage output of the oscillator 74 is then raised by a transformer 76 which comprises an integral part of the oscillator circuit, to provide a ±2500 volt square or sine wave output at the specified frequency range.

The air motor 52, alternator 62, rectifier 70, voltage regulator 72, oscillator 74 and transformer 76 can be arranged to conveniently form an essentially integral subassembly which, when potted, forms a monolithic element that is readily replaceable.

The high frequency high voltage output of the transformer 76 is introduced into a long chain multiplier 80, suitably a series multiplier of about 20 or more stages, to elevate the input voltage into a desired 30 to 100 kilovolt rectified output voltage which is fed to the electrode assembly in the air cap 32 via lead 84 and a limiting resistance 82. A major part of limiting resistance 82 may alternatively be placed between the low voltage end of cartridge 45, and the grounded handle 14.

As mentioned earlier, spray guns of the type herein of concern employable in commercial electrostatic paint spraying or other coating operations must satisfy and fall within a practical and established framework of mechanical and electrical parameters. In general, handholdable electrostatic spray guns desirably should weigh less than three pounds, should provide an operating potential of from 30 to 100 kilovolts at a current level of about 50 microamperes and should be operable with conventional plant supply of compressed air at pressures from about 20 to 80 psig. In addition, such guns must include means for limiting the current flow to prevent deleterious arc-type discharge when the high voltage electrode approaches a grounded object.

The following portions of this specification will describe, in more detail, a presently preferred embodiment of a self-contained electrical power supply for electrostatic spray guns that (a) weighs about ½ pound; (b) is operable from conventionally available compressed air supplies of from 20 to 80 psig at a flow rate no greater than 5 scfm; (c) provides a 50 kilovolt minimum output at 50 microamperes with a maximum current flow of about 200 microamperes at short circuit; and (d) is conveniently formed as a replaceable cartridge to facilitate field servicing of the spray equipment--all of which permit ready cartridge type incorporation within handholdable spray guns and concomitant satisfaction of the currently accepted and recognized mechanical and electrical parameters therefor.

The air motor 52, alternator 62, rectifier 70 and voltage regulator 72 subassembly preferably is desirably constructed to provide exemplary operating characteristics such as (a) relatively constant output voltage of 5–10 volts DC at a power level of 5–8 watts from a 20–80 psig oil free air supply utilizing less than 5 scfm of compressed air exhausting at atmosphere pressure; (b) acceleration of the air motor rotor 56 and armature 60 to 80% of full speed within a maximum of about 0.2 second from trigger actuation; and (c) a light weight, in the order of 3 ounces, with a concomitant structural durability to provide for long operating life.

Figure 2:
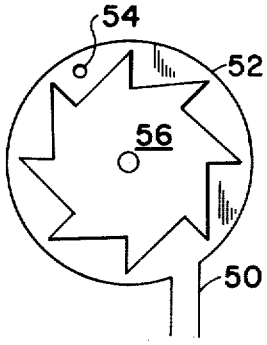
FIG. 2 is a schematic vertical section of a suitable air motor configuration.
Figure 3:
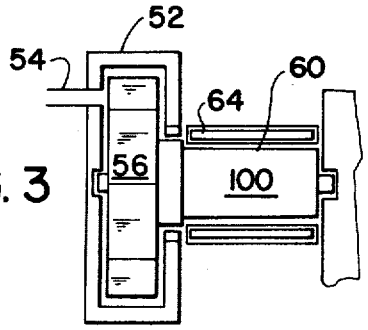
FIG. 3 is a schematic sectional view of a suitable air motor-alternator subassembly construction.

As best shown in FIGS. 2 and 3, a presently preferred construction for the air motor 52 comprises a simple impulse type air motor wherein a light weight rotor 56 of about 2.5 cm. in diameter which, when exposed to an entering air stream through nozzle 50 moving at about 300 meters/sec. has a theoretical maximum speed of about 300,000 r.p.m., thus conveniently and readily permits of operation at speeds in the order of 10,000 to 30,000 r.p.m. while providing the necessary torque to drive the alternator 62 in such manner as to provide the desired power output from the available kinetic energy in the moving air stream.

Compressed air flowing at about 4 scfm at a pressure of 40 psig has a theoretical power capability of about 200 watts. Since the desired output of the rectifier is in the order of about 10 watts or less, the described system renders the full pressure drop available to drive the air motor 52 and associated alternator 62. Additionally, the above described preferred impulse turbine type of air motor avoids the utilization of sliding seals and permits the use of ball bearings, oil impregnated bushings or other suitable bearing elements, suitably of the type employed in dentists' drills and the like for long-lived high speed operation.

In order to obtain the desired rapid acceleration of the armature 60 of the alternator 62, the inertia of the air motor rotor 56 and armature 60 must be kept as small as possible. To the above ends, the armature 60 preferably comprises a high energy permanent magnet 100 about ⅝ inch long and about ½ inch in diameter. Present knowledge indicates that magnet diameters in excess of ½ inch are attended by unacceptable inertia characteristics. Alnico 8 is a preferred material for such magnet armature although Alnico 5 could also be used. As previously noted, the armature 60 is arranged to be effectively integral with the rotor 56 and is located immediately externally adjacent the air motor housing 52.

Figure 4:
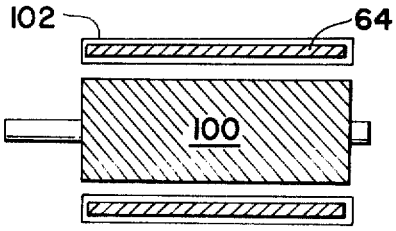
FIG. 4 is a schematic vertical sectional view, in somewhat enlarged form, of a suitable alternator construction.

As best shown in FIGS. 3 and 4, the stator of the alternator 62 consists of a hollow epoxy coated cylinder 64 of high permeability alloy steel to minimize hysteresis losses in the core. The commonly available tape wound core construction is preferred and also minimizes eddy current losses. The windings on the stator 64 form two coils and are selected to provide an output voltage of about 12 volts AC and to match the impedance requirements of the rectifier 70, voltage regulator 72 and oscillator 74. The entire stator and winding assembly is encapsulated or potted as indicated at 102 to provide a monolithic type structure. The above described alternator 62 is of simple and rugged construction and is characterized by a low starting torque that permits the rapid attainment of an operating speed of about 15,000 r.p.m. in less than ¼ second to effect delivery of 5 to 10 watts of power at a voltage level of about 12 volts.

Figure 5:
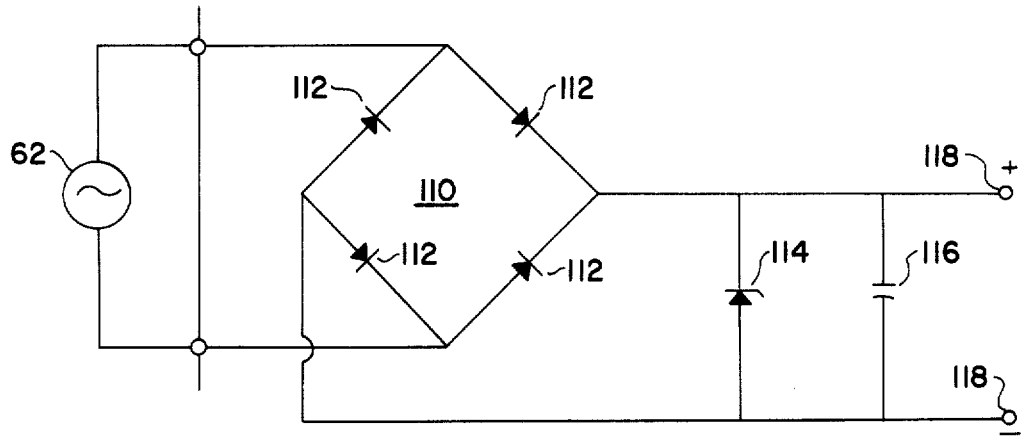
FIG. 5 is a schematic circuit diagram of a rectifier-voltage regulator circuit.

The remaining components of the power supply are electrical in nature and are constituted of essentially conventional circuitry and circuit elements with the values of the circuit elements being selected to operate within the heretofore and hereinafter identified parameters. By way of illustrative example, FIG. 5 delineates a suitable circuit arrangment for the rectifier 70 and voltage regulator 72 that serves to convert the 8–16 volts r.m.s. alternting voltage output of alternator 62 into a constant d.c. voltage of about 8–12 volts in magnitude. As there shown, the alternator 62 is connected across a bridge rectifier 110 made up of solid state diodes 112. The bridge output is connected across a zener diode 114 and a filtering capacitor 116 to provide a substantially constant d.c. output across terminals 118.

As described earlier, the high frequency oscillator 74 is preferably designed to provide a square wave type output in the frequency range of from 10 to about 50 kilohertz at a voltage level commensurate with the previously indicated 8 to 12 volt DC input thereto. The high frequency alternating output of the oscillator is then transformed up to a plus or minus 2500 volt square wave for introduction into the first stage of the multiplier 80.

Figure 6:
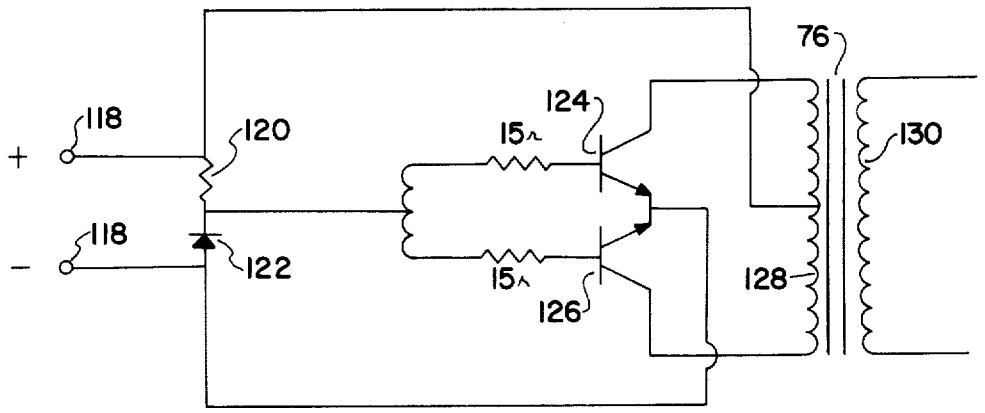
FIG. 6 is a schematic circuit diagram of an oscillator-transformer circuit.

FIG. 6 schematically illustrates a suitable circuit for such oscillator 74 and transformer 76. As shown, the output terminals 118 of the regulator 72 are connected across a resistor 120 and diode 122. The oscillator circuit includes a pair of transistors 124, 126 having the output thereof connected across the primary winding 128 of transformer 76. The stepped up voltage output of about ±2500 volts at a frequency of from 10 to 50 kilohertz is delivered by the secondary winding 130 of the transformer.

The air motor, alternator, rectifier, voltage regulator, oscillator and transformer preferably constitute a monolithic (when potted) subassembly that is replaceable as a unit and forms the first of the cartridge components.

Figure 7:
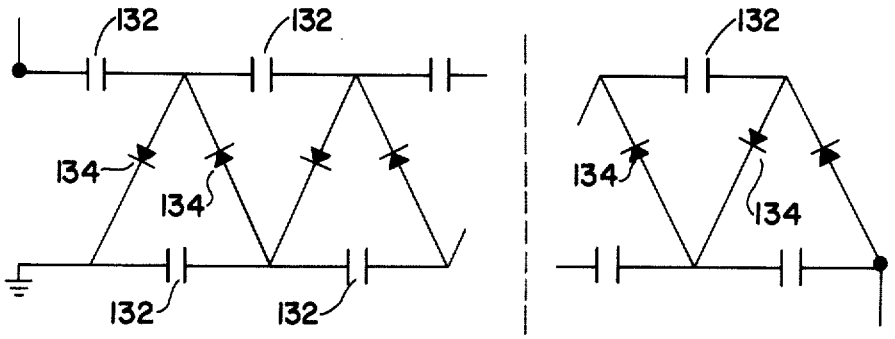
FIG. 7 is a schematic circuit diagram of a suitable long chain series voltage multiplier.

Such preferred ±2500 volt square wave output from the transformer 76 is applied to the input terminals of the long chain multiplier 80. FIG. 7 schematically illustrates a suitable circuit for a multistage, suitably about 24 stages, series multiplier to provide a 60 kilovolt output. Since the size and weight of any such unit is determined by the size and weight of the electrical elements, i.e. capacitors and rectifiers, forming the multiplier chain, the plus or minus 2500 volt input permits the utilization of standard 5 KV components which are diminutive in size and light in weight. As shown, such chain conventionally includes a plurality of stages each formed of series connected capacitors 132 bridged by diodes 134.

Any type of series or parallel long chain multiplier may be employed although a series multiplier is presently preferred. The multiplier preferably constitutes the second monolithic subassembly (when potted) that is replaceable as a unit and forms the second of the cartridge components.

As will now be apparent, all of the electronic components, i.e. air motor 52, alternator 62, rectifier 70, regulator 72, oscillator 74, and transformer 76, as one subassembly and the multiplier 80 as a second subassembly may be assembled in closely packed array and suitably encapsulated to form separable monolithic type structures that compositely form parts of the cartridge and together are readily field replaceable.

Figure 8:
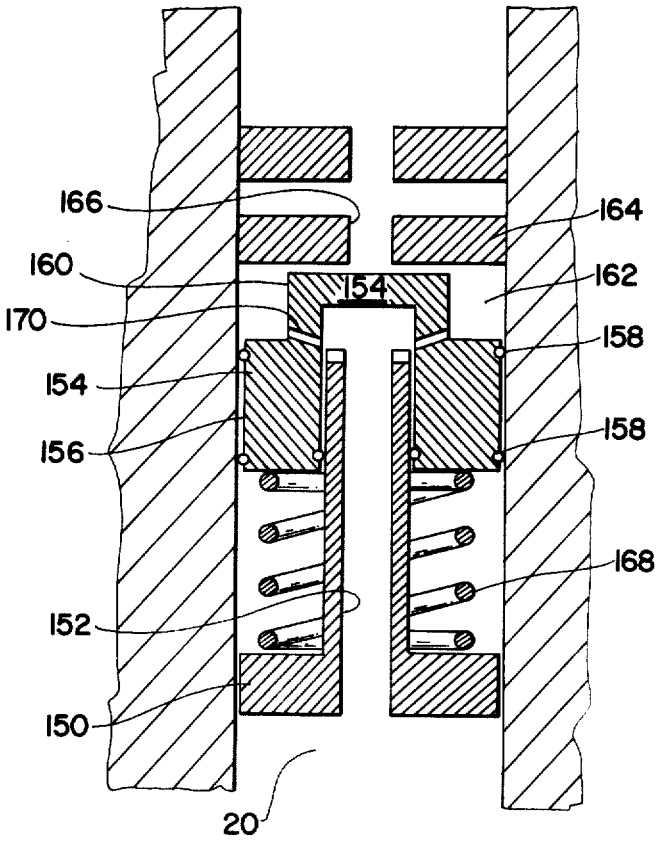
FIG. 8 is a schematic vertical section of an air pressure regulator device.

In order to limit the voltage output and to prevent over driving of the air motor 52, an air regulator assembly 148 is preferably included in the auxiliary air flow conduit 28 in handle 14. FIG. 8 schematically illustrates a simple air regulator assembly. As shown, a sleeve 150 defining an elongate central bore 152 of markedly reduced air flow cross section is placed in the conduit 28. The bore 152 is capped by a displaceable valve member 154. The base portion 156 of the valve member 154 is disposed in sliding interfacial engagement with the walls of an enlarged portion of conduit 28 where suitable O rings 158 are desirably interposed to prevent leakage of air therepast. The upper portion 160 of the valve member 154 is of reduced transverse extent to provide a chamber 162 thereabout. The chamber 162 is also bounded by a plug 164 having a central bore 166 of reduced air flow cross section. The plug 164 is located to limit upward displacement of the valve member 154 which is normally biased in closed interfacial engagement therewith by the spring 168. Also included in the valve member 154 are a plurality of angularly disposed conduits or channels 170 which permit air flow from the bore 152 to the chamber 162 when the dependent ends thereof are not closed by the end of the sleeve 150.

In operation of the subject unit, the valve member 154 is normally biased into sealing relation with the bore 166 of the plug 164. Air pressure extant within the chamber 162, however, will displace the valve member downwardly against the action of the biasing spring 168 serving to open the bore 166 and to partially or fully close the channels 170. The closure or partial closure of the channels 170 reverses the action and permits the spring 168 to control and move the plug upwardly. As will be apparent, proper dimensioning of the elements will serve to limit the effected pressure on the upstream side to a predetermined value independent of the pressure in the downstream line and thus regulate the air input to the air motor.

A prototype system constructed in accord with the foregoing principles readily provides a 55 KV output at 3 watts D.C. from a 20 psig regulated compressed air input at 4.2 scfm. The following operational and physical parameters were attained:

| Air Motor - Alternator Subassembly | |
|---|---|
| Air Input | 20 psig; 4.2 scfm |
| Output | 8.6 watts at 12.1 volt rms and 250 hertz |
| Dimensions (D × L) | 1.375" × 1.355" |
| Weight | 2.4 oz. |

-continued

| | |
|---|---|
| Rise Time | less than 0.1 sec. to 90% of rated power |
| Rectifier-Regulator-Oscillator-Transformer | |
| Input | as above |
| Output | 5.1 KV (peak) at 20 KHz and 5.4 watts |
| Dimensions | 1.375" × 1.0" |
| Weight | 2.25 oz. (encapsulated) |
| High Voltage Multiplier | |
| Input | as above |
| Output | 55 KV at 3 watts D.C. |
| Dimensions (D × L) | 0.875" × 4.75" |
| Weight | 4.0 oz. (encapsulated) |

Having thus described my invention, I claim:

1. Electrostatic spray coating apparatus devoid of external electrical power connection thereto comprising means for emitting a spray of atomized coating material, electrode means disposed adjacent the locus of atomization of said coating material for applying an electric charge to said atomized coating material, and a self-contained electrical potential originating power supply for providing the operating voltage for said electrode means, said self-contained electrical potential originating power supply including, means for converting the kinetic energy of a moving air stream derived from a remote source thereof into an alternating voltage, and long chain voltage multiplying means for converting said alternating voltage into a high direct current voltage for application to said electrode means.

2. Electrostatic spray apparatus as set forth in claim 1 wherein said kinetic energy converting means includes an air turbine driven alternator and a transformer for raising the magnitude of said alternating voltage before application thereof to said voltage multiplying means.

3. Electrostatic spray coating apparatus devoid of external electrical power connection thereto comprising means for emitting a spray of atomized coating material, electrode means disposed adjacent the locus of atomization of said coating material for applying an electrical charge to said atomized coating material, a self-contained electrical potential originating power supply for providing the operating voltage for said electrode means, said self-contained electrical potential originating power supply including, means for converting the kinetic energy of a moving stream of air derived from a remote source thereof into an alternating voltage of low magnitude, means for converting said low magnitude alternating voltage into a substantially constant magnitude direct current voltage, oscillator means responsive to said substantially constant magnitude direct current voltage for providing a high frequency, high magnitude, alternating voltage output, and long chain voltage multiplying means for converting the high frequency, high magnitude output of said oscillator means into a direct current voltage of higher magnitude for application to said electrode means.

4. Electrostatic spray apparatus as set forth in claim 3 wherein said kinetic energy converting means includes rotatable turbine means drivable by said stream of air from a compressed source thereof and an alternator driven by said turbine means.

5. Electrostatic spray apparatus as set forth in claim 3 wherein said means for converting said low magnitude alternating voltage into a substantially constant magnitude direct current voltage includes a rectifier and a voltage regulator.

6. Electrostatic spray apparatus as set forth in claim 3 wherein said voltage multiplying means is a multi-stage series multiplier circuit.

7. Electrostatic spray apparatus as set forth in claim 4 wherein said turbine means further comprises an impulse-type air motor.

8. Electrostatic spray apparatus as set forth in claim 4 wherein said alternator driven by said turbine means includes a solid magnet armature directly connected to said turbine means.

9. Electrostatic spray coating apparatus devoid of external electrical power connection thereto comprising means for emitting a spray of atomized coating material, electrode means disposed adjacent the locus of atomization of said coating material for applying an electrical charge to said atomized coating material, a self-contained electrical potential originating power supply for providing the operating voltage for said electrode means, said self-contained potential originating electrical power supply including, air driven turbine-generator means for converting the kinetic energy of a moving stream of air into a low frequency, low magnitude alternating voltage, means for converting said low frequency, low magnitude alternating voltage into a substantially constant direct current voltage of low magnitude, an oscillator responsive to said direct current low magnitude voltage for providing a high frequency alternating voltage output, step-up transformer means associated with said oscillator for delivering a high magnitude alternating voltage at the output frequency of said oscillator, and long chain voltage multiplying means for converting the output of said transformer means into a direct current voltage of still higher magnitude for application to said electrode means.

10. Electrostatic spray apparatus as set forth in claim 9 wherein said kinetic energy converting means includes an impulse type, rotatable turbine drivable by a stream of air from a compressed source thereof, and an alternator driven by said turbine adapted to provide an output voltage of about 12 volts at a frequency of about 250 hertz.

11. Electrostatic spray apparatus as set forth in claim 9 wherein said means for converting said low frequency, low magnitude alternating voltage includes a rectifier and a voltage regulator adapted to provide a d.c. output voltage of about 10 volts.

12. Electrostatic spray apparatus as set forth in claim 9 wherein said oscillator is adapted to provide an alternating output voltage at a frequency in the range of from 10 to 50 kilohertz.

13. Electrostatic spray apparatus as set forth in claim 9 wherein said transformer means is adapted to provide an alternating output of about plus or minus 2500 volts.

14. Electrostatic spray apparatus as set forth in claim 9 wherein said voltage multiplying means is a multi-stage series multiplier circuit adapted to provide an output voltage in the range of from 30 to 100 kilovolts.

15. Electrostatic spray apparatus as set forth in claim 10 wherein said alternator driven by said turbine means includes a solid magnet armature directly connected to said turbine means.

16. Electrostatic spray apparatus as set forth in claim 3 wherein said alternating voltage converting means and oscillator means are encapsulated to form a first monolithic cartridge subassembly.

17. Electrostatic spray apparatus as set forth in claim 3 wherein said voltage multiplying means is encapsulated to form a second monolithic cartridge subassembly.

18. Electrostatic spray apparatus as set forth in claim 3 wherein said kinetic energy converting means, alternating voltage converting means, oscillator means and transformer means and voltage multiplying means are encapsulated to form a monolithic cartridge element removably insertable in said electrostatic spray coating apparatus.

19. Electrostatic spray apparatus as set forth in claim 9 wherein said kinetic energy converting means comprises a first monolithic subassembly; said alternating voltage converting means, oscillator means and transformer means comprises a second monolithic subassembly; said voltage multiplying means comprises a third monolithic subassembly and said first, second and third subassemblies comprise a readily assemblable and disassemblable cartridge.

20. In an electrostatic spray coating apparatus incorporating means for emitting a spray of coating material and electrode means for applying an electric charge to the emitted coating material, a self-contained electrical potential originating power supply devoid of external electrical power connection thereto for providing the operating voltage for said electrode means comprising means for converting the kinetic energy of a moving gas stream derived from a remote source thereof into kinetic energy of a rotating solid, and means for converting the kinetic energy of said rotating solid into electrical energy for application to said electrode means.

21. Electrostatic spray apparatus as set forth in claim 20 wherein said kinetic energy converting means comprises an impulse type air driven turbine.

22. Electrostatic spray apparatus as set forth in claim 21 wherein said kinetic energy converting means further comprises an alternator driven by said turbine and providing an alternating voltage output therefrom.

23. Electrostatic spray apparatus as set forth in claim 20 wherein said last mentioned means is an alternator providing a low frequency, low magnitude alternating voltage output, and said apparatus further comprises, means for converting said low frequency, low magnitude alternating voltage into a substantially constant magnitude direct current voltage, oscillator means responsive to said direct current voltage for providing a high frequency, high voltage alternating voltage output, and long chain voltage multiplying means for converting the output of said oscillator means into a direct current voltage of still higher magnitude for application to said electrode means.

24. In an electrostatic spray coating gun adapted to be connected to a source of fluid under pressure and to emit a spray of coating material including electrode means for applying an electric charge to the emitted coating material, a self-contained electrical power supply for providing the sole source of electrical potential to said electrode means, said self-contained electrical power supply comprising means for converting a portion of the energy of a fluid under pressure to an alternating voltage, and long chain voltage multiplying means for converting said alternating voltage into a high direct current potential, sufficient for use in electrostatic spraying, for application to said electrode means.

25. In a hand manipulable electrostatic spray coating gun adapted to be connected to a source of fluid under pressure and to emit a spray of coating material including electrode means for applying an electric charge to the emitted coating material, self-contained electrical power supply for providing the sole source of electrical power to said electrode means, said self-contained electrical power supply comprising a first monolithic subassembly for converting a portion of the energy of a fluid under pressure to an alternating voltage, and a second monolithic subassembly for converting said alternating voltage into a high direct current potential, sufficient for use in electrostatic spraying, for application to said electrode means, said first and second subassemblies each being removably insertable in said electrostatic spray coating gun.

26. Electrostatic spray apparatus as set forth in claim 1, 3, 9, 23 or 24, wherein said long chain voltage multiplying means is a multi-stage series multiplier circuit including at least 20 stages.

27. Electrostatic spray apparatus as set forth in claim 1, 3, 9 or 20, wherein said means for emitting a spray, electrode means, and self-contained electrical potential originating power supply are carried by a common framework with said electrostatic spray apparatus.

28. Electrostatic spray apparatus as set forth in claim 27, wherein said self-contained electrical potential originating power supply comprises a plurality of assemblable cartridges.

29. Electrostatic spray apparatus as set forth in claim 27, wherein said self-contained electrical potential originating power supply has a total weight of about ½ pound.

30. Electrostatic spray apparatus as set forth in claim 1, 3 or 20, wherein said kinetic energy converting means includes turbine means operably arranged to drive alternator means, said turbine means being adapted to be driven by said moving air stream and to accelerate said alternator means from rest to an operating speed of about 15,000 rpm in about ¼ second.

* * * * *